US005770034A

United States Patent [19]

Jansen et al.

[11] Patent Number: 5,770,034

[45] Date of Patent: Jun. 23, 1998

[54] PROCESS AND APPARATUS FOR DESILVERING A SILVER-CONTAINING SOLUTION

[75] Inventors: Benedictus Jansen, Geel; Fernand Ketels, Kontich; Paul Smet, Wilrijk; Werner Van de Wynckel, Mortsel; Michiels Frank, Arendonk, all of Belgium

[73] Assignee: Agfa-Gevaert N.V., Mortsel, Belgium

[21] Appl. No.: 676,442

[22] Filed: Jul. 8, 1996

Related U.S. Application Data

[60] Provisional application No. 60/003,755, Sep. 14, 1995.

[30] Foreign Application Priority Data

Jul. 15, 1995 [EP] European Pat. Off. ..... 95201954

[51] Int. Cl.[6] ..... C25C 1/20; C25C 7/06

[52] U.S. Cl. ..... 205/571; 205/702; 205/771; 204/228; 204/231

[58] Field of Search ..... 205/571, 702, 205/771; 204/228, 231

[56] References Cited

U.S. PATENT DOCUMENTS

| | | | |
|---|---|---|---|
| 4,018,658 | 4/1977 | Alfin et al. | 204/109 |
| 4,362,608 | 12/1982 | Biles et al. | 204/109 |
| 4,377,456 | 3/1983 | DeMeester et al. | 204/231 |
| 4,612,102 | 9/1986 | Brimo et al. | 204/228 |
| 4,978,433 | 12/1990 | Iwano et al. | 205/761 |
| 5,118,402 | 6/1992 | Engels et al. | 205/571 |

*Primary Examiner*—Aron S. Phasge

*Attorney, Agent, or Firm*—Baker & Botts, L.L.P.

[57] ABSTRACT

An apparatus for desilvering silver-containing solutions comprises an electrolytic cell (10) having an anode (20), a cathode (30) and a reference electrode (45) positioned adjacent the cathode (30), and electrical power supply control means (41) for controlling the supply of electrical power to the anode (20) and the cathode (30). The power supply control means (41) includes means (60) for adjusting the cathode potential and control means (70) linked to said adjustment means (60) to reduce the cathode potential, at least periodically, as the desilvering process continues. The process leads to better silver adhesion on the cathode occurs, while maintaining good desilvering levels in the solution, and cathode poisoning is minimised.

19 Claims, 3 Drawing Sheets

PROCESS AND APPARATUS FOR DESILVERING A SILVER-CONTAINING SOLUTION

This application claims the benefit of the US Provisional Application No. 60/003,755 filed Sep. 14, 1995.

DESCRIPTION

Field of the Invention

The present invention relates to a process and apparatus for the electrolytic recovery of silver from solutions containing silver, in particular used photographic solutions such as fixing and bleach-fixing solutions.

Background of the Invention

Electrolytic silver recovery from used photographic solutions is a common way to extend the life of such solutions.

An apparatus for the electrolytic recovery of silver from solutions containing silver is known from European patent application EPA 93200427.8 (Agfa-Gevaert NV) filed 16 Feb. 1993. The apparatus comprises an electrolytic cell having an anode and a cathode, and electrical power supply control means for controlling the supply of electrical power to the anode and the cathode.

The control of the electrochemical process taking place at the anode and the cathode is important in the silver recovery process. If too high a potential difference is applied, side reactions can occur, depending upon the nature of the silver-containing solution, leading to unwanted by-products. There are a number of known methods of controlling the desilvering process, including for example the methods referred to herein as (i) galvanostatic, (ii) constant potential difference and (iii) potentiostatic.

In galvanostatic control, a constant current flows through the cell while it is in operation. As the desilvering progresses, the level of silver in the solution falls and the ohmic resistance between the anode and the cathode increases. It is therefore necessary to increase this potential difference in order to maintain a constant current. While the instrumentation required for this control is very simple, the method suffers from the fact that at high silver concentrations the potential difference is small and therefore desilvering takes place only slowly, while at low silver concentrations the potential difference is sufficiently high that undesirable side reactions are liable to occur, adhesion of the silver to the cathode is bad and sulphidation of the cathode occurs.

In a constant potential difference control method, the potential difference between the anode and the cathode is kept constant as the desilvering progresses. The disadvantage of this method is that the potential difference between the cathode and the solution itself is not controlled. The electrochemical reactions taking place at the cathode are therefore uncontrolled, depending on a large number of factors such as the size of the anode, agitation in the neighbourhood of the anode, the presence or absence of components in the solution which can be oxidised and the ease with which they can be oxidised (e.g. $SO_3^{--}$ and $S_2O_3^{--}$), the ohmic potential drop in the cell and therefore also the cell geometry and current density, and the current through the cell.

In potentiostatic control, a reference electrode is included in the electrolytic cell and the potential difference between the cathode and the reference electrode is kept constant. This allows complete control over the cathode potential. This method of operation is therefore widely preferred, since it is the cathode potential which determines electrochemical reactions which take place in a fixer of a given composition. By using a reference electrode, the influence of the anode potential (and largely also the ohmic potential contributions) are excluded. This enables the cathode potential to be set at a level where bad silver adhesion, side reactions and sulphiding of the cathode can be avoided, independently of the anode potential. The use of a reference electrode makes the equipment more reliable, since factors such as the current density at the anode, the surface state of the anode, overpotential at the anode (caused by changes in solution composition), and ohmic potential drops no longer influence the cathode potential. As the desilvering process continues and silver is removed from the solution, the current through the cell falls while the potential difference between the cathode and the reference electrode is maintained at a fixed level. When fresh solution with a higher silver content is subsequently added, the current through the cell will normally increase and silver continues to be deposited on the cathode.

The advantage of potentiostatic control has long been recognised (see for example French patent FR 1357177 (Bayer) and it is also used in commercial equipment (e.g. ECOSYS F08, ECOMIX, and ECORAP 72/51 ex Agfa-Gevaert NV).

The de-silvering process proceeds by depositing silver upon the cathode. If the silver does not adhere strongly to the cathode, there is a risk that it will become detached therefrom, especially as the weight of silver deposited increases and especially in continuously operated cells which have a constant flow of electrolyte solution passing over the cathode. The detached silver may fall to the bottom of the cell where it eventually builds up to a level which may cause a short circuit between the anode and the cathode. Alternatively or additionally the detached silver is flushed out of the cell with the electrolyte liquid. In either case the de-silvering of the solution is not optimally achieved. This bad adhesion will normally occur more frequently when the silver containing solution is de-silvered to low silver levels.

In practice moreover, it is sometimes observed that, although the silver content of the bath to be desilvered is high (for example >3 g/l) and the desilvering apparatus as such is working correctly, no silver becomes deposited on the cathode. This last effect is thought to be due to "cathode poisoning", i.e. chemical components present in the solution inhibit or otherwise disturb the deposition of silver in such a way that silver is no longer deposited on the cathode. Photographic stabilizers, such as PMT (phenyl mercapto tetrazol), have been observed to have this effect.

SUMMARY OF THE INVENTION

It is an object of the present invention to provide a process for the desilvering of silver-containing solutions in which better silver adhesion to the cathode occurs, whilst maintaining good desilvering levels in the solution and in which the above mentioned cathode poisoning phenomena is minimised.

We have discovered that the above-mentioned object may be achieved by the use of an alternative method of controlling the desilvering process.

According to the invention there is provided a process for desilvering a silver-containing solution by use of an electrolytic cell having an anode, a cathode and a reference electrode, the process comprising:

(i) supplying silver-containing solution to the electrolytic cell to immerse the anode, cathode and reference electrode therein; and (ii) applying electrical power to the anode and the cathode such that the cathode potential relative to the reference electrode, lies within a desilvering range to cause silver to be deposited on said cathode; characterised by reducing the cathode potential, at least periodically, as the desilvering process continues.

In a first embodiment of the invention, referred to herein as periodic control, the cell is firstly operated under potentiostatic conditions. After a given period of time, the cathode potential is decreased (made more negative) to a predetermined level. For example, when the solution is placed in the cell, and the apparatus is switched on, the cell current is high and the cathode potential is set at a first level. As the desilvering process continues and the level of silver in the solution falls, the cell current falls. During this time the cathode potential is maintained at its first level. After a given period of time however, the cathode potential is adjusted to a lower (i.e. more negative) level. The cathode potential is held at this lower level for a given period of time, referred to herein as a detoxification period, after which it is returned to the first level.

In preferred embodiments of the invention which make use of periodic control, the cathode potential in the detoxicating step is from 20 to 150 mV, preferably from 20 to 80 mV, more negative than in the preceding desilvering step.

The process according to the invention preferably includes a plurality of desilvering steps interposed by detoxicating steps. The predetermined period of time during which the detoxicating step is performed may be less than 30%, most preferably less than 10%, of the immediately preceding desilvering step and may for example be from 1 to 300 minutes per detoxicating step, the higher end of this range being appropriate when de-silvering takes place, albeit on and off, over several days. We have found that for a continuously running desilvering apparatus, a total of the predetermined periods of time for all detoxicating steps amounting to between 1 and 60 minutes per day gives effective results. By ensuring that the detoxicating steps occupy only a minimum part of the total de-silvering time, the total charge which is passed through the electrolysis cell in the detoxicating steps is limited.

In an alternative control embodiment, the cathode potential is reduced according to a predetermined relationship between the cathode potential and the current flowing through the cell.

It has not previously been proposed to reduce the cathode potential as the desilvering process takes place, in accordance with the current flowing through the cell and therefore independently of any changes in the anode potential. The predetermined relationship between the cathode potential and the cell current is of a form whereby the cathode potential is lower (i.e. more negative) as the cell current falls. In simplified form this relationship may be expressed as:

$$U=U_o+\kappa(I-I_{max})$$

where U is the cathode potential when the cell current is I, $U_o$ is the cathode potential when the cell current is at its maximum $I_{max}$, and κ is a positive non-zero coefficient, which in the simplest case is a constant. Note that if κ were zero, this relationship would reduce to $U=U_o$, i.e. the potentiostatic control method.

Preferably κ is so chosen that the minimum cathode potential (which occurs when I=0) i.e. $U_o-\kappa I_{max}$, is not so low that undesirable side reactions occur to a significant extent. In the case of cathode poisoning, it may be advisable to chose larger values for κ. κ is also chosen so as not to fully compensate for the fall in current, i.e. the cell current will continue to fall as the desilvering continues. If κ were so chosen as to fully compensate for the fall in cell current, the cell current I would remain constant, corresponding to the galvanostatic control method.

The best value of κ will depend upon the maximum current $I_{max}$, and the nature of the cell and can be determined by prior calibration. We have found however, that where $U_o$ is between −560 mV and −480 mV, $\kappa \cdot I_{max}$ preferably lies between 10 mV and 200 mV, most preferably between 20 mV and 80 mV.

This embodiment of the invention may be carried out continuously, whereby the cathode potential is continuously adjusted to a level determined by the cell current, in accordance with the predetermined relationship. Thus for example, when the solution is placed in the cell, the cell current is high and the cathode potential is at a first level. As the desilvering process continues and the level of silver in the solution falls, the cathode potential is adjusted to lower (i.e. more negative) levels determined by the cell current, in accordance with the predetermined relationship. When, for example, the silver levels rise, the cell current rises and the cathode potential is adjusted to higher (i.e. less negative) levels determined by the cell current, in accordance with the predetermined relationship and the control sequence is repeated.

A control regime which embodies part periodic control and part continuous control is also possible within the scope of the present invention.

The present invention is based upon the discovery that the effects of poor silver adhesion and cathode poisoning during the desilvering step can be substantially overcome by applying a lower cathode potential during part of the desilvering process, so that in the next desilvering step the efficiency of the process substantially returns and is maintained for a number of further desilvering steps. While it is known that the application of a lower cathode potentials may lead to side reactions and the generation of unwanted by-products, by limiting the cathode potential to a level determined by the cell current, or by limiting the total charge which is passed through the electrolysis cell, the effect of such side reactions, such as for example the reduction of sulphite at the cathode surface, over the whole desilvering process is minimised. It is indeed surprising that even a detoxification period of relatively short duration can be sufficient to overcome the cathode poisoning which has built up over a relatively long desilvering step and that cathode poisoning is reduced for a period of time which is longer than the duration of the detoxication period itself.

The present invention also provides an apparatus for desilvering silver-containing solutions, the apparatus comprising an electrolytic cell having an anode, a cathode and a reference electrode positioned adjacent the cathode, and electrical power supply control means for controlling the supply of electrical power to the anode and the cathode, the power supply control means including means for adjusting the potential difference between the cathode and the reference electrode, and control means linked to the adjustment means to reduce the cathode potential, at least periodically, as the desilvering process continues.

The silver-containing solution may be selected from photographic fixing and bleach-fixing solutions. The silver concentration in the silver-containing solution is typically from 0.1 g/l to 5 g/l. Where the silver-containing solution is a fixing solution, the process of the invention is particularly effective if the fixing solution has a volume of less than 100 ml/g, most preferably less than 40 ml/g, of silver to be fixed thereby, because at low replenishment rates, the importance of unwanted side reactions becomes greater.

In one embodiment of the process, before any desilvering takes place, a "kick-start" is applied whereby the electrical power applied to the cell is maintained at a start-up level for the cathode potential of less than −650 mV, preferably less than −700 mV, as measured with a glass electrode, for a predetermined period of time, such as for a period of less than 3 minutes, preferably less than 30 seconds, and is then maintained within the desilvering range until the first detoxicating step.

The silver-containing solutions which can be desilvered using the apparatus according to the present invention include any solution containing silver complexing agents, e.g. thiosulphate or thiocyanate, sulphite ions and free and complexed silver as a result of the fixing process. The apparatus can also be used with rinsing water or concentrated or diluted used fixing solutions, possibly contaminated with carried-over developer. Apart from the essential ingredients, such solutions will often also contain wetting agents, buffering agents, sequestering agents and pH adjusting agents. The silver-containing solution may comprise compounds preventing the formation of fog or stabilizing the photographic characteristics during the production or storage of photographic elements or during the photographic treatment thereof. Many known compounds can be added as fog-inhibiting agent or stabilizer to the silver halide emulsion. Suitable examples are inter alia the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methylbenzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in British patent Nos. GB 1203757, GB 1209146 and GB 1500278 and Japanese patent application No. 75-39537, and 7-hydroxy-s-triazolo-[1,5-a]-pyrimidines as described in U.S. Pat. No. US 4727017, and other compounds such as benzenethiosulphonic acid, benzenethiosulphinic acid and benzenethiosulphonic acid amide. Other compounds that can be used as fog-inhibiting compounds are metal salts such as, for example, mercury or cadmium salts and the compounds described in Research Disclosure No. 17643 (1978), Chapter VI.

The process is particularly applicable in cases of low replenishment rates, because components carried over from the developer for example and components which are flushed out of the film (such as stabilizers, surfactants and sensitizers), are more concentrated. In particular, surfactants may aggravate the poisoning effects of stabilizers such as PMT.

The apparatus of the present invention can also be used for desilvering bleach-fixing solutions which may additionally contain bleaching agents such as complexes of iron(III) and polyaminocarboxylic acids.

The desilvering process can be carried out batch-wise or continuously, the apparatus being connected to the fixing solution forming part of a continuous processing sequence. In a continuous process, the silver-containing solution may continue to be fed to the cell during the detoxicating period (step). The apparatus according to the invention may be designed to be operated manually, automatically or automatically with manual over-ride.

The material used for the anode is not especially critical, although platinated titanium is usually used. Platinum, graphite and nobel metals are alternatives. The anode may be in the form of a rod, located at the axis of the electrolytic cell, where this is in cylindrical form.

The cathode may be formed from a generally flat sheet of flexible material, an electrically conductive surface being provided on one major face thereof, securing means being provided to enable the sheet to be folded into and secured in an open circular cross-sectional configuration. The cathode preferably ideally has a frusto-conical cross-section, with its larger radius end uppermost, that is towards the circular upper opening of the electrolyte cell. This configuration enables easy removal of the cathode even after a silver deposit has built up there-on after use. Usable cathode materials include stainless steel, silver and silver alloys, and other conductive materials, the non-silver containing materials being preferred from the point of view of costs, while the silver containing materials cause fewer starting-up problems.

The positioning of the reference electrode is important to the desilvering process. While in principle the electrode would be best placed between the cathode and the anode, as close as possible to the cathode, this may cause troubles as more and more silver is deposited on the cathode, which is thus growing thicker. When the reference electrode is placed further from the cathode, say 20 mm therefrom, ohmic potential drops will cause the potentiostatic desilvering not to be truly potentiostatic. It has therefore been proposed to place the reference electrode on the far side of the cathode from the anode, but close to the cathode. We prefer to place the reference electrode at a distance of 5 mm from the cathode, and the potential difference values quoted herein are based on such a distance. If the reference electrode is placed nearer to or further from the cathode, an appropriate correction needs to be applied. In any event, the reference electrode should preferably be positioned at a location, such as from 1 mm and 50 mm from the cathode, where the potential measured while the cell is in operation, corresponds within 100 mV, preferably within 30 mV, to the potential that would be measured with the reference electrode in front of the cathode.

In one embodiment of the electrolytic cell, the cathode includes an opening extending from the outer face to the inner face, the opening being located in the neighbourhood of the reference electrode to ensure that the reference electrode is located within the electrical field of the cell.

The reference electrode may conveniently be positioned adjacent the outlet port of the cell. Reference electrodes suitable for use in electrolytic desilvering include calomel type electrodes or Ag/AgCl type electrodes, but we particularly prefer the use of a pH sensitive electrode such as a glass electrode, a hydrogen electrode, a quinhydrone electrode and an antimony electrode, most especially a glass electrode which is relatively maintenance free and which is moreover insensitive to hydrostatic pressure variations. The potential at which the reduction of sulphite starts to take place is dependant on the pH of the fixing solution. Therefore, the potential to be used for optimum desilvering is dependant upon the nature of the fixer used and other parameters such as the pH of the developer bath, the presence or absence of intermediate rinsing, the degree of carry over from the developer to the fixer, and the buffering capacities of the developer and the fixer solutions.

We prefer that the reference electrode is a pH sensitive electrode. A suitable electrode has been disclosed in European patent application EP 598144 (Agfa-Gevaert NV).

In a preferred embodiment of the invention, the electrolytic cell comprises a housing, an anode, a removable cathode and a reference electrode all positioned within the housing. The cathode has an inner face directed towards the anode and an outer face directed towards the reference electrode. In use, silver from the silver containing solution is deposited on the face of the cathode which is directed towards the anode.

In a suitable embodiment of the invention, the electrolytic cell housing is formed of electrically non-conductive material and may be generally cylindrical, although other shapes are possible. A cylindrical shape to the cell enables the cathode to be positioned near to the wall of the housing. The anode has a generally linear configuration axially located within the housing. The cathode has an open circular cross-sectional configuration surrounding the anode. The reference electrode is located in a side arm of the housing. Preferably, the housing further comprises a liquid inlet and a liquid outlet for the electrolyte liquid, predetermining a liquid level within the cell. In an embodiment of the cell, the housing is provided with an electrically conductive contact surface above the liquid level and clamping means serve to clamp a contact portion of the cathode against the contact surface of the housing to complete an electrical connection to the cathode. The contact portion of the cathode should have an electrically conductive surface. The provision of the contact surface in an upper part of the electrolytic cell housing, in particular an annular contact surface, enables this surface to be above the level of the electrolyte in the cell in use, thus reducing the risk of leakage and corrosion.

Where the electrolytic cell includes a liquid inlet and a liquid outlet, the process according to the invention may include the step of continuously supplying silver-containing solution to the cell through the inlet and continuously removing desilvered solution from the outlet. The silver-containing solution may be supplied to the electrolytic cell at rate of from 5 to 25 1/minute.

BRIEF DESCRIPTION OF THE DRAWINGS

The invention will now be further described, purely by way of example, by reference to the accompanying drawings in which.

DETAILED DESCRIPTION OF PREFERRED EMBODIMENTS OF THE INVENTION

Figure 1:
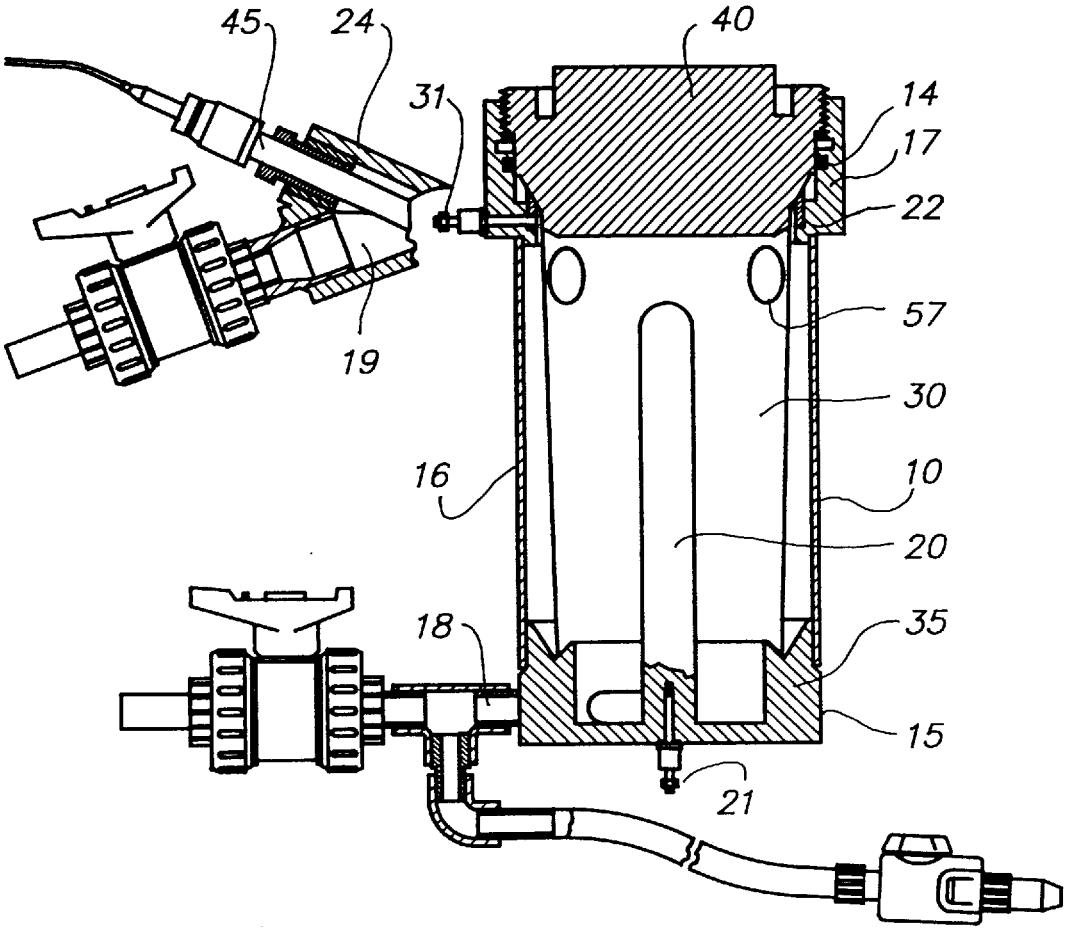
FIG. 1 shows, partly in cross-section, an electrolytic cell for use in accordance with the invention.

As shown in FIG. 1, the apparatus comprises an electrolytic cell 10, formed of electrically nonconductive material such as PVC, and comprising a base 15, sides 16 and an upper portion 17. An electrolyte inlet port 18 is provided towards the bottom of the cell and an electrolyte outlet port 19 is provided towards the top of the cell.

An anode 20, in the form of a platinised titanium rod, is secured to the base of the cell by means of a bolt 21 which acts as an electrical connector for the anode. The anode 20 lies along the axis of the cell 10. A reference electrode 45 is positioned in a side arm 24 of the cell 10 and protrudes into the outlet port 19 of the cell. A suitable reference electrode is a pH sensitive glass electrode such as a YOKOGAWA SM21/AG2 glass electrode.

The upper part 17 of the cell is in the form of a neck portion having an opening defined by a stainless steel ring 22. The contact surface of the ring 22 is frusto-conically shaped, having its narrower radius downwards. The stainless steel ring 22 is permanently fixed to one end of a bolt 31 which extends through the wall of the cell and provides a connector for the cathode 30. Positioned in the neck of the cell, above the level of the annular ring 22, is a sealing ring 14.

The apparatus further comprises a lid 40 so shaped as to fit into the neck portion of the cell. The lid 40 is formed of electrically non-conductive material such as PVC. The lower portion of the lid 40 is shaped to correspond to the shape of the ring 22.

The cathode 30, formed for example of a flat stainless steel sheet 50 having a thickness of 100 $\mu$m, is wrapped around into a frusto-conical configuration, where the upper radius is marginally larger than the lower radius by a factor of 1.05. The cathode 30 has a deformable upper edge portion. The sheet material of which the cathode is formed is sufficiently resilient to allow upper edge portion to bend outwardly in response to outwardly directed force. The deformable upper edge portion of the cathode lies adjacent the stainless steel ring 22. Tightening of the lid causes the upper edge portion of the cathode 30 to be clamped firmly by the lid against the ring 22, thereby establishing good electrical contact there-between.

The cathode is provided with a number of openings 57 which extend therethrough. The cathode 30 is located in the cell 10 with its bottom edge supported by a cathode support ledge 35 in the cell. One of the openings 57 is located in the neighbourhood of the reference electrode 45.

In the closed position of the lid, the sealing ring 14 bears against the outer surface of the lid 40, thereby forming a tight seal. Electrolyte liquid is now fed into the cell by way of the inlet port 18, fills the cell and exits by way of the outlet port 19. The effect of the sealing ring 14 is to prevent the electrolyte level rising above the level of the outlet port 19, so maintaining an air space above the liquid and preventing contact between the liquid and the surface of the ring 22. The risk of corrosion of the latter is thereby reduced and the opening of the cell is made easier because the air space fulfils a compression-decompression function.

Figure 2:
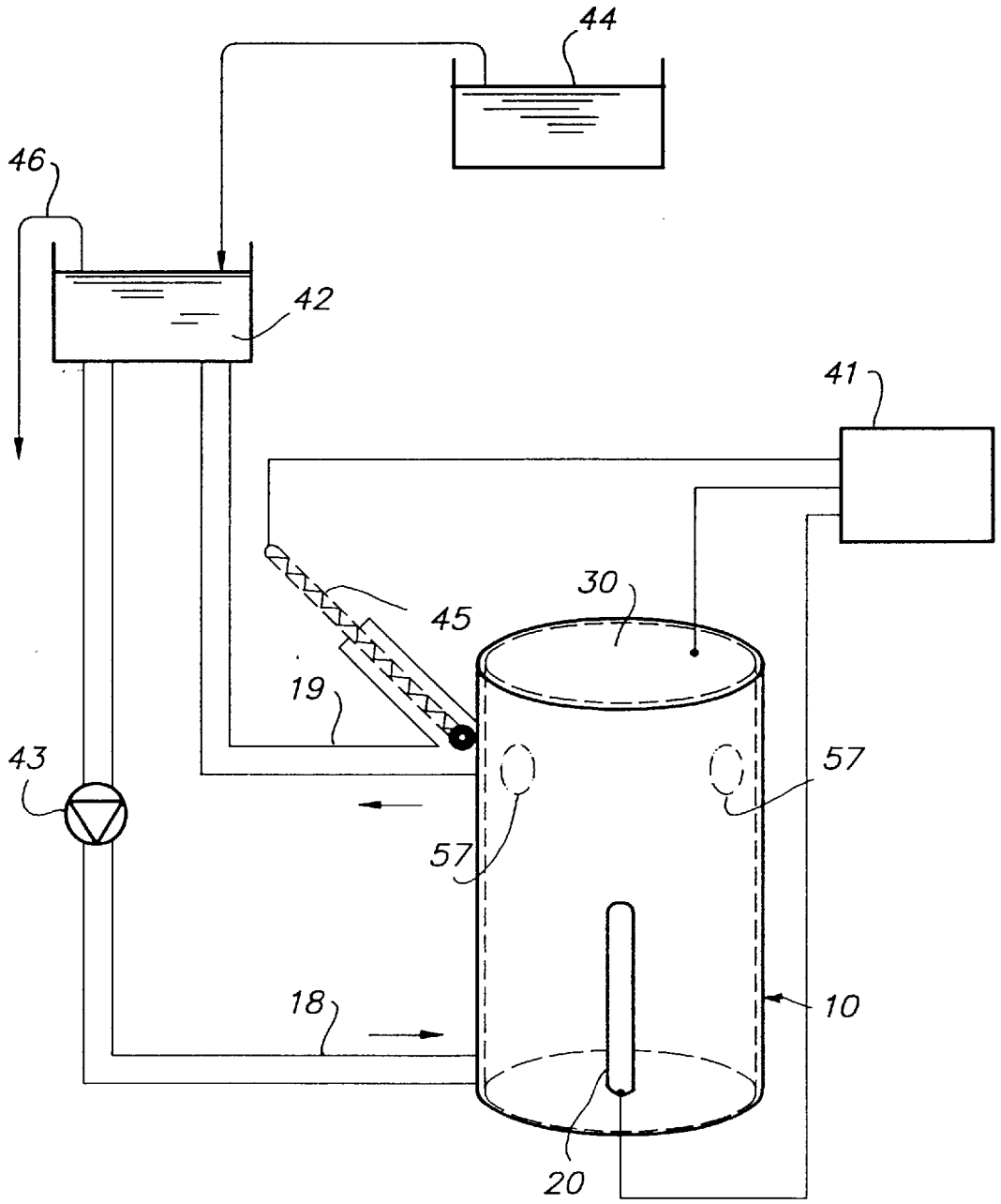
FIG. 2 is a schematic representation of the use of an apparatus according to the present invention.

Referring to FIG. 2 it will be seen that the anode 20, the cathode 30 and the reference electrode 45 of the electrolytic cell 10 are connected to a potential control device 41 which controls the application of electrical power to the anode and the cathode. The cell 10 is fed with contaminated fixer from a first fixer container 42 via a pump 43 which is provided with a filter (not shown).

The contaminated fixing solution is topped up from time to time with fresh fixing solution from a second fixer container 44, while the total liquid volume is maintained at a constant level by means of an overflow 46.

Figure 3:
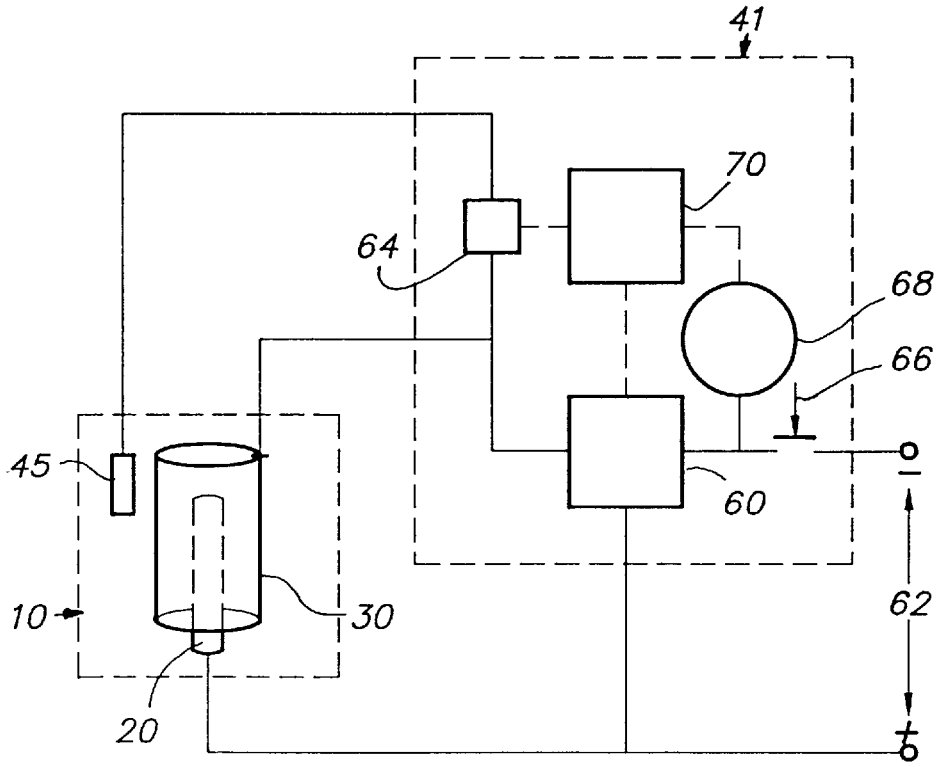
FIG. 3 is a schematic representation of a control circuit for use in the present invention.

FIG. 3 shows the apparatus for desilvering silver-containing solutions comprising the electrolytic cell 10, the anode 20, the cathode 30 and the reference electrode 45 positioned adjacent the cathode. Electrical power supply control means in the form of the potential control device 41 is provided for controlling the supply of electrical power to the anode 20 and the cathode 30. The potential control device 41 includes a potentiometer 60 for adjusting the potential difference applied from a power source 62 between the anode 20 and the cathode 30. A voltage meter 64 measures the potential difference between the cathode 30 and the reference electrode 45 and a current meter 65 measures the current flow through the cell. A start switch 66 initiates the start of a desilvering process by completing the connection between the power source 62 and the cathode 30. A timer 68 measures the time elapsed from the operation of the start switch 66. A control circuit 70 is linked to the voltage meter 64, the current meter 65 and the timer 68 and is programmed to adjust the potentiometer 60 in response to the timer 68, the voltage meter 64 and the current meter 65 in accordance with the predetermined relationship between cathode potential and cell current.

EXAMPLES 1 to 3

An electrolysis experiment was performed with an electrolysis cell as described in European patent application EP 598144 referred to above, but with a pH electrode having a potential of +280 mV against a normal hydrogen electrode (NHE). The solution to be desilvered was a commercially available photographic fixer G333 having a pH of 5.3 which was loaded with 2 g/l silver. A new cathode was used.

In Example 1* (Comparative), the desilvering was performed at a constant cathode potential of −530 mV.

In Example 2* (comparative) the desilvering was performed at a constant cathode potential of −470 mV.

In Example 3 (illustrating the invention) the cathode potential U was constantly adjusted in accordance with the relationship $$U=U_o+\kappa(I-I_{max})$$

where $U_o$=−470 mV, $I_{max}$=3 amps and κ=20 mV/amp. Thus the cathode potential was initially at −470 mV when the cell current was 3 amps and was decreased (made more negative) as the cell current fell, at a rate of 20 mV per amp. At the end of the experiment the cell current was, for example, standing at 0.4 amp, with the cathode potential at −518 mV.

In each of Examples 1 to 3 the residual silver level was measured and the silver adhesion quality was examined and judged to be bad when the surface of the cathode was granular-like and the granules could be easily rubbed away.

The results were as follows:

| Example: | 1* | 2* | 3 |
|---|---|---|---|
| Residual silver level (g/l) | 0.1 | 0.75 | 0.15 |
| Silver adhesion | poor | good | good |

EXAMPLE 4

A processing experiment was performed in a commercially available CX402 processor (ex Agfa-Gevaert). Commercially available Curix HT films, which had been one third exposed, were processed at a rate of 10 $m^2$ per day using a commercially available fixer G334RC (ex Agfa-Gevaert). The fixer was regenerated with 200 ml/$m^2$ film. The fixer was desilvered with an electrolysis cell as described above. The electrolytic cell was equipped with an automatic start/stop control, according to which the power to the cell is shut off if the cell current should fall below 200 mA and thereafter the power is reinstated after 20 minutes. The purpose of this control is to remove the need for an operator to start the electrolysis when silver containing solution is being fed to the cell and to stop the electrolysis when desilvering is complete.

The cell was operated successfully for 5 days, with residual silver levels lying between 0.3 and 0.5 g/l and approximately 30 g silver being deposited each day (as estimated from the integrated current through the cell). The pH was relatively constant at about 4.6.

After two days break the experiment was continued and on the first day the cell operated successfully as before. On the second day however the automatic start/stop control failed to start the electrolysis, even though the silver content in the solution fed to the cell was 2.5 g/l, indicating poisoning of the cathode. Therefore, the potential was set to −590 mV. Desilvering then continued successfully, leading to a residual silver level of 0.22 g/l. The cathode potential was then set to −530 mV again.

During the following 3 days the cell was further operated with a cathode potential of −530 mV and residual silver levels remained below 0.4 g/l, indicating that the desilvering efficiency had returned to the position before poisoning.

For the sake of clarity, potential differences mentioned throughout this specification are, unless otherwise specified, measured with a glass reference electrode, with a potential of +208 mV relative to NHE at pH 7 at room temperature and positioned as described in European patent application EP 598144, referred to above, or where the electrodes are positioned at other locations in the cell. Where other forms of reference electrode are used, appropriate modifications of the potential differences referred to herein are necessary, as will be clear to those skilled in the art.

We claim:

1. A process for desilvering a silver-containing solution in an electrolytic cell having an anode, a cathode and a reference electrode, said process comprising the steps of:

supplying a sufficient quantity of said silver-containing solution to said electrolytic cell to immerse said anode, said cathode and said reference electrode in said silver-containing solution;

applying an electrical potential between said cathode and said reference electrode at a first potential level within a first potential range and corresponding to a cell current value, said first potential level being effective to cause silver to be deposited on said cathode; and reducing the absolute magnitude of said electrical potential from said first level to enhance said desilvering process.

2. The process according to claim 1, wherein the absolute magnitude of said electrical potential is reduced to a lower level effective to detoxify said cathode.

3. The process according to claim 1, wherein said electrical potential is reduced as a function of said cell current value.

4. The process according to claim 3, wherein said electrical potential between said cathode and said reference electrode is dependent upon (i) a cathode potential corresponding to a maximum cell current and (ii) the difference between said cell current said maximum cell current.

5. The process according to claim 4, wherein said electrical potential between said cathode and said reference electrode is determined by the relationship:

$$U=U_o+\kappa(I-I_{max}),$$

wherein U is said cathode potential at said cell current I, $U_o$ is said cathode potential corresponding to a maximum cell current $I_{max}$, and κ is a positive non-zero coefficient.

6. The process according to claim 5, wherein said positive non-zero coefficient κ is constant.

7. The process according to claim 5, wherein the quantity κ times $I_{max}$ is within the range of 10 to 200 mV.

8. The process according to claim 1, wherein:

said electrical potential applying step further comprises applying said electrical potential under potentiostatic conditions for a first period of time;

said electrical potential reducing step further comprises reducing the absolute magnitude of said electrical potential from said first level to a second lower detoxifying level within a second potential range for a second period of time subsequent to said first period of time; and re-applying said electrical potential, under potentiostatic conditions, between said cathode and said reference electrode to a potential level within said first potential range for further desilvering.

9. The process according to claim 8, wherein said detoxifying level is 20 to 150 mV less than said first potential level.

10. The process according to claim 8, wherein said first potential range is approximately −560 to −480 mV.

11. The process according to claim 8, wherein said second period of time is less than 30% of said first period of time.

12. The process according to claim 8, wherein said second period of time is from 1 to 300 minutes.

13. The process according to claim 8, wherein said electrical potential is applied at levels within said first and second potential ranges a plurality of times in an alternating sequence of desilvering and detoxification steps.

14. The process according to claim 1, further comprising the steps of:

applying said electrical potential, prior to desilvering, at a start-up level within a start-up range less than −650 mV; and maintaining said start-up level for less than 3 minutes.

15. The process according to claim 1, wherein said silver-containing solution has a silver concentration of 0.1 g/l to 5.0 g/l.

16. The process according to claim 1, wherein said silver-containing solution is a fixing solution having a volume of less than 100 ml per gram of silver to be fixed thereby.

17. The process according to claim 1, wherein said silver-containing solution comprises a photographic stabilizer.

18. The process according to claim 1, wherein:

said electrolytic cell further comprises a liquid inlet and a liquid outlet; and said supplying step comprises the steps of:

continuously supplying said silver-containing solution to said electrolytic cell through said liquid inlet, and continuously removing desilvered solution through said liquid inlet.

19. An apparatus for desilvering silver-containing solutions comprising:

an electrolytic cell comprising:

an anode, a cathode, and a reference electrode positioned adjacent said cathode; and means for controlling an electrical potential applied between said cathode and said reference electrode at a first potential level within a first potential range and corresponding to a cell current value, said first potential level being effective to cause silver to be deposited on said cathode, said control means comprising means for adjusting said electrical potential such that the absolute magnitude of said electrical potential is reduced intermittently from said first level to enhance said desilvering process.

* * * * *